US007909089B2

(12) United States Patent
Jackson

(10) Patent No.: US 7,909,089 B2
(45) Date of Patent: Mar. 22, 2011

(54) DOWNHOLE JET PUMP

(75) Inventor: Thomas Roland Jackson, Conroe, TX (US)

(73) Assignee: J & J Technical Services, LLC, Conroe, TX (US)

( * ) Notice: Subject to any disclaimer, the term of this patent is extended or adjusted under 35 U.S.C. 154(b) by 233 days.

(21) Appl. No.: 11/821,056

(22) Filed: Jun. 21, 2007

(65) Prior Publication Data

US 2008/0314578 A1 Dec. 25, 2008

(51) Int. Cl.
*E21B 43/00* (2006.01)

(52) U.S. Cl. ..... 166/68; 166/105

(58) Field of Classification Search ..... 166/68, 166/105; 417/172
See application file for complete search history.

(56) References Cited

U.S. PATENT DOCUMENTS 4,128,109 A * 12/1978 Chervenak et al. ..... 137/375
4,135,861 A * 1/1979 Brown et al. ..... 417/183
4,280,662 A * 7/1981 Erickson et al. ..... 239/591
4,504,195 A * 3/1985 Binks et al. ..... 417/172
4,603,735 A 8/1986 Black
4,658,893 A 4/1987 Black
4,664,603 A * 5/1987 Priestly ..... 417/172
4,790,376 A 12/1988 Weeks
5,055,022 A 10/1991 Hirschberger
5,083,609 A 1/1992 Coleman
5,372,190 A 12/1994 Coleman
6,698,521 B2 * 3/2004 Schrenkel et al. ..... 166/369
6,978,841 B2 * 12/2005 Hoffman et al. ..... 166/381
7,032,578 B2 * 4/2006 Liu et al. ..... 123/568.15
2001/0016173 A1 * 8/2001 Watanabe et al. ..... 418/171
2005/0121191 A1 * 6/2005 Lambert et al. ..... 166/265
2007/0187111 A1 * 8/2007 Misselbrook et al. ..... 166/377

* cited by examiner

*Primary Examiner* — William P Neuder
(74) *Attorney, Agent, or Firm* — Browning Bushman PC

(57) ABSTRACT

One embodiment of a downhole jet pump 10 includes an exterior pump housing 12, power fluid jet nozzle 30, mixing tube 32, and a carrier 40 including a plurality of venturi ports 38. A nose piece 48 is provided fluidly downstream from the mixing tube 32. A diffuser 46 is downstream from the nose piece, and preferably forms a unitary body from the lower end of the nose piece to the side port of the pump housing. An inlet valve 100 passes formation fluid into the pump housing and to the venturi ports.

41 Claims, 2 Drawing Sheets

DOWNHOLE JET PUMP

FIELD OF THE INVENTION

The present invention relates to jet pumps and, more particularly, to jet pumps commonly used downhole in wells to pump formation fluids, which may be either hydrocarbons, water, or another liquid, to the surface. The downhole jet pump as disclosed herein is capable of a substantially longer and more reliable life than prior art jet pumps.

BACKGROUND OF THE INVENTION

Those skilled in the hydrocarbon recovery industry recognize the increasing significance of jet pumps in recovering formation fluids. The potential for jet pumps for pumping formation fluids from a well to the surface is enhanced by its relatively low cost compared to systems which use a reciprocating or rotating rod string to pump fluids to the surface. For many applications, jet pumps are preferable compared to electric submersible pumps, which are frequently not considered reliable for use in producing high solid content formation fluids.

Various problems have limited the success of jet pumps in the hydrocarbon industry. More particularly, manufacturers have not recognized the components of jet pumps which should be better protected in order to enhance the pump life and reliability. Many jet pump components are subjected to a unique combination of conditions which enhance corrosion and/or abrasive wear. Jet pumps have been manufactured for decades, but the prior art has not recognized the fluid flow characteristics of jet pumps which have limited their efficiency and reliability.

A downhole jet pump which was retrievable by reverse flow is disclosed in U.S. Pat. No. 5,083,609. Further improvements to a downhole jet pump are disclosed in U.S. Pat. No. 5,372,190. The '190 patent discloses a pump with a retrievable nozzle and mixing tube. The mixing tube may be pressed within two carriers by a chemical adhesive.

U.S. Pat. No. 4,603,735 discloses another type of jet pump having a reverse up flow. U.S. Pat. No. 4,790,376 discloses a pump wherein power fluid may be injected down the annulus and produced up the tubing string, or power fluid may be injected down the tubing string and produced up the annulus. U.S. Pat. No. 5,055,022 discloses a type of downhole jet pump with a retrievable nozzle assembly. U.S. Pat. No. 4,658,893 also discloses a downhole jet pump with a reverse flow ejection nozzle.

The disadvantages of the prior art are overcome by the present invention, and an improved jet pump is hereinafter disclosed.

SUMMARY OF THE INVENTION

In one embodiment, a downhole jet pump is provided for positioning in a well from a tubular string to pump formation fluids from the well into the annulus surrounding the tubing string. The jet pump includes an exterior pump housing defining an elongate housing passageway therein extending from an upper portion to a lower portion of the pump housing, and a power fluid jet nozzle having an exterior sealed to the pump housing. The jet nozzle has a central passageway therein for increasing fluid velocity of the power fluid transmitted downhole through the tubular string and to the jet nozzle. The pump also includes a mixing tube positioned downstream from the jet nozzle and having an elongate mixing tube passageway for receiving fluid from the jet nozzle. A plurality of venturi ports are provided in a carrier for drawing formation fluids from within the pump housing radially through the venturi ports and into the mixing tube. A nose piece within the housing downstream from the mixing tube has a nose piece passageway in fluid communication with the mixing tube passageway, and a diffuser downstream from the nose piece has a lower end passing through a side port in the pump housing for discharging the mixture of power fluid and formation fluids to the annulus surrounding the pump housing. An inlet valve, commonly referred to as a standing valve, is provided for passing formation fluid into the pump housing and to the venturi ports. In another embodiment, the components of the jet pump are arranged for pumping a power fluid down the annulus, and receiving power fluid and formation fluid through the tubing string.

These and further features and advantages of the present invention will become apparent from the following detailed description, wherein reference is made to the figures in the accompanying drawings.

DESCRIPTION OF THE PREFERRED EMBODIMENTS

Figure 1:
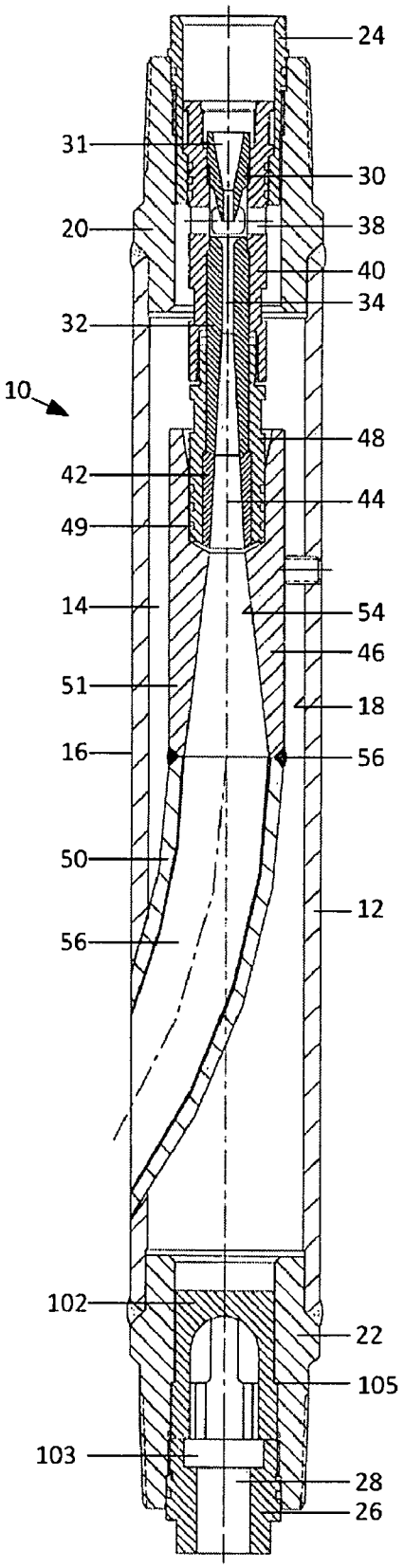
FIG. 1 is a cross-sectional view of a suitable embodiment of a downhole jet pump according to the present invention.

FIG. 1 depicts one embodiment of a downhole jet pump 10 according to the present invention for positioning within a well from a tubular string to pump formation fluid from the well to an annulus surrounding the tubing string, and then from that annulus up to the surface. Those skilled in the art will appreciate that a downhole jet pump may be used for pumping liquid hydrocarbons from a well, but may also be used for pumping other fluids, such as water, to enhance the production of gas or other valuable fluids. Also, the jet pump disclosed below is adapted for receiving power fluid from a tubular, and pumping both the power fluid and the formation fluid to the surface from the annulus. Various functional components of a jet pump may alternatively be arranged for reverse flow, as explained subsequently, so that the power fluid is transmitted down the annulus and the formation fluid and power fluid are recovered at the surface through the tubular string.

The jet pump 10 includes an exterior pump housing 12 which defines an elongate housing passageway 14 therein extending from an upper portion to a lower portion of the pump housing. The exterior pump housing 12 preferably has a generally outer cylindrical surface 16 and a generally cylindrical inner surface 18 which defines the passageway in the pump housing. The pump housing is thus generally tube or sleeve shaped, with its ends welded to a top pin 20 and a bottom pin 22, respectively. A top sub 24 is adapted for sealing engagement with a tubular string, while the top pin 20 seals with the tubing string. An inlet valve nut (bottom sub) 26 may be provided at the lower end of the pin 22, and has a passageway 28 providing an inlet for hydrocarbons into the pump housing.

FIG. 1 depicts a power fluid jet nozzle 30 with a passageway 31 which becomes axially restrictive in the downward direction, thereby increasing the velocity of power fluid transmitted through the jet nozzle. The jet nozzle 30 is supported on and has an exterior sealed to the carrier 40 which contains the venturi ports 38. The carrier 40 is sealed by a metal to metal seal 29 formed by the shoulder on the carrier and the matching shoulder the top sub. Another seal is provided as a backup and comprises conventional O-rings sealed with the top sub 24. A mixing tube 32 is provided fluidly downstream from the jet nozzle, and has an elongate mixing tube passageway 34 receiving power fluid from the jet nozzle 30 and formation fluid through venturi ports 38. A plurality of venturi ports 38 also discussed below are provided immediately below the nozzle 30 and within the upper portion of carrier 40. These venturi ports allow entry of formation fluids from within the housing 12 radially through the venturi ports and into the mixing tube 32. For the embodiment shown in FIG. 1, the carrier 40 which houses the nozzle 30 and all or at least a portion of the mixing tube 32 is formed as a unitary component, and is discussed further below. The mixing tube 32 preferably is formed from a tungsten carbide alloy material to define the mixing tube passageway 34.

A nose piece 48 is provided within the housing 12 fluidly downstream from the mixing tube 32. The nose piece 48 may be part of carrier 40, or may be formed separate from then threaded to the carrier 40. The nose piece has a nose piece passageway 44 in fluid communication with the mixing tube passageway 34. The nose piece 48 is preferably provided with a carbide material liner 42 along the entire length of that portion of the nose piece which fluidly connects mixing tube passageway 34 with the interior of diffuser 46. In a preferred embodiment, the carbide material liner 42 is shrink fit within the nose piece. The selected liner material is one of tungsten carbide, silicon carbide, and boron carbide.

The pump as shown in FIG. 1 also includes a diffuser 46 downstream from the nose piece 48. The lower end 49 of the nose piece seals within a bore in the upper end of the diffuser 46. The lower portion 50 of the diffuser 46 and the upper portion 51 of the diffuser form a rigid body, with the groove space for weld 56 to fuse the upper and lower portions of the diffuser together. The upper portion 51 of the diffuser 46 includes a conical or otherwise expanding passageway 54, and the lower portion 50 of the diffuser includes a substantially circular curved bore 56. The pieces 50 and 51 are mated and are welded together to ensure integrity and reduce manufacturing costs. FIG. 1 further illustrates that the lower end 49 of the nose piece may functionally serve as an upper portion of the diffuser, since venturi bore 44 may also be a conical or otherwise expanding bore to pump the fluids toward the annulus. Interior surface 54 of both the upper 51 and lower 50 portions of the diffuser are preferably clad with a selected metal coating along the entire length of this surface.

Figure 3:
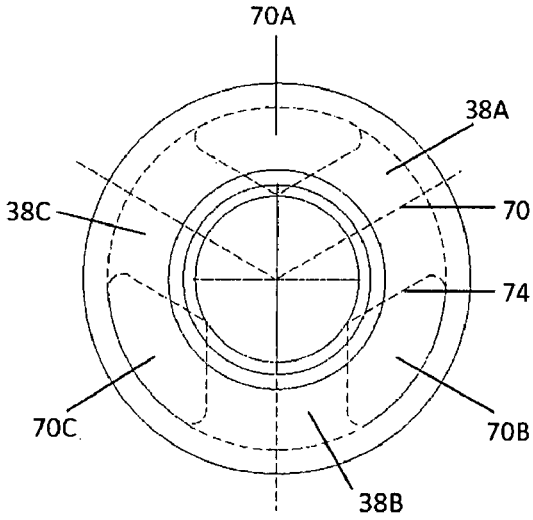
FIG. 3 is an end view through the ports in the carrier shown in FIG. 2.

The mixing tube passageway 34 is thus in communication with the interior 31 of the jet nozzle 30 and with the interior 44 of the nose piece 48. The carrier 40 preferably has three venturi ports 38A, 38B, and 38C as shown in FIG. 3 each extending through the side wall of carrier 40 and between the interior passageway in the pump housing and the mixing tube passageway 34. The venturi ports 38 are spaced substantially equidistant circumferentially about the carrier 40. A feature of the invention is to provide three venturi ports, although in the past pumps of this type have had four or more ports. Providing three venturi ports results in three legs 70A, 70B, and 70C spaced respectively between the ports, thereby providing high structural integrity with very little mass. Secondly, the venturi ports conventionally are provided with a circular cross-section. The three venturi ports according to the present invention preferably are provided with a curved corner, generally rectangular cross-section, which significantly reduces the drag and thus increases the efficiency of the process.

Figure 2:
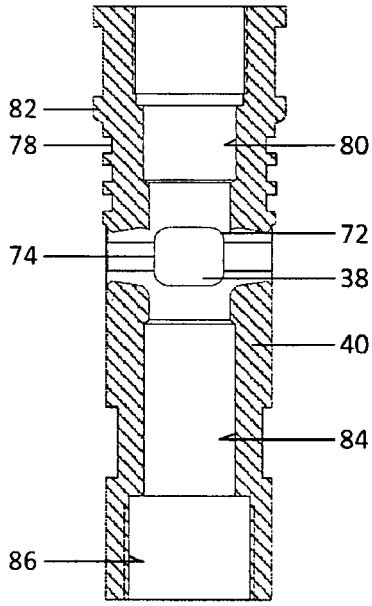
FIG. 2 is a cross-sectional view of the carrier with venturi ports generally shown in FIG. 1.

The carrier 40 has three equally spaced venturi ports 38 as shown in greater detail in FIGS. 2 and 3. Each of the legs 70A, 70B, and 70C forming the three venturi ports allows each port to have a substantially rectangular configuration defined by substantially parallel left and right side surface 74. The cross sectional area of the ports is increased significantly compared to prior art circular ports. As shown in FIG. 3, each of the side surfaces 74 is also preferably substantially parallel to a central axis 76 of the respective venturi port. Each port has a central axis 76.

The carrier 40 as shown in FIG. 2 preferably has a plurality of annular grooves 78 for receiving axially spaced sealing members, and has an interior surface 80 for receiving the nozzle 30 shown in FIG. 1. Flange 82 on the carrier engages a stop surface in the sleeve 24 shown in FIG. 1. The interior cylindrical surface 84 of the carrier is sized for receiving the mixing tube 32 shown in FIG. 1, and an enlarged portion 86 includes interior threads for receiving the upper threaded end of the nose piece 48.

The entirety of the carrier 40 including the venturi ports 38 is preferably formed from a powdered metallurgy material, which leaves a high percentage of voids in the material which can be coated with a vapor deposition material to enhance abrasion and wear characteristics.

Carrier 40 as shown in FIGS. 1 and 2 may functionally serve as a carrier, in that the carrier may be retrieved to the surface while leaving the pump housing in place, and may also carry both the nozzle 30, the mixing tube 32, and the nose piece 48 when pulled to the surface, or when the subassembly including the carrier is lowered back into the well to engage the remaining downhole components of the pump. In other applications, the carrier includes a plurality of through ports, but otherwise does not serve as a retrievable component separate from the pump housing, and/or does not support other components as the carrier is run into or out of the well separate from the pump housing. The term "carrier" as used herein is thus intended to refer to the component which functionally includes the venturi ports, and optionally also serves as a carrier for other components.

Figure 4:
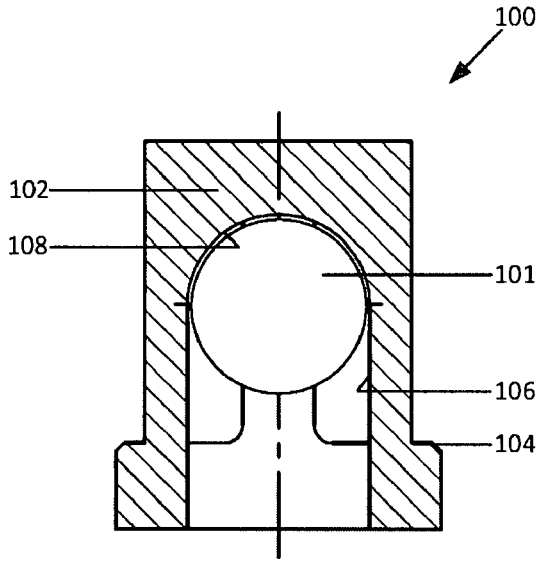
FIG. 4 is a cross-sectional view of the ball cage generally shown in FIG. 1.
Figure 5:
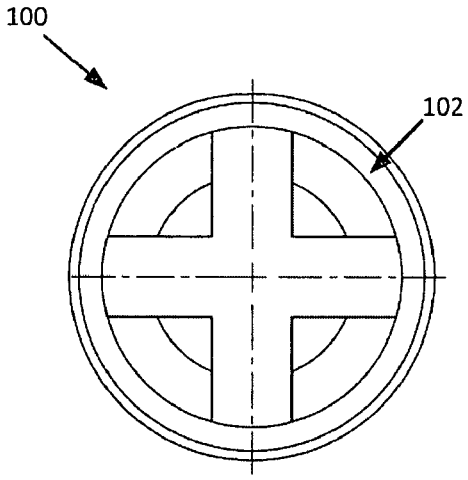
FIG. 5 is an end view of the ball cage shown in FIG. 4.

An inlet or standing valve 100 as shown in FIG. 4 is provided at the lower end of the pump housing, and more specifically within the bottom pin 22, as shown in FIG. 1. As shown in FIGS. 4 and 5, the ball cage 102 engages the bottom pin 22 which is sealed to the pump housing, and has a metal sealing surface 104 for sealing engagement with a similar metal sealing surface 105 in the bottom pin 22. The ball cage 102 is provided with an interior surface 106 which acts as a guide to limit movement of the ball between the open and closed positions to substantially linear movement, which in this application is substantially vertical movement. The cross-section of the fluid passageway for the ball from the open to the closed positions may not need to be straight, but a majority of the entire length of the passageway should have a cross-sectional diameter substantially no greater than 150% of the diameter of the ball 101 to limit radial movement of the ball during operation of the valve. The ball cage end surface 108 has a radius substantially equal to or greater than the radius of the ball 101 within the ball cage. The ball cage is preferably formed M-4 machine tool stainless steel formed from powdered metal technology, and is then preferably boron coated.

Figure 6:
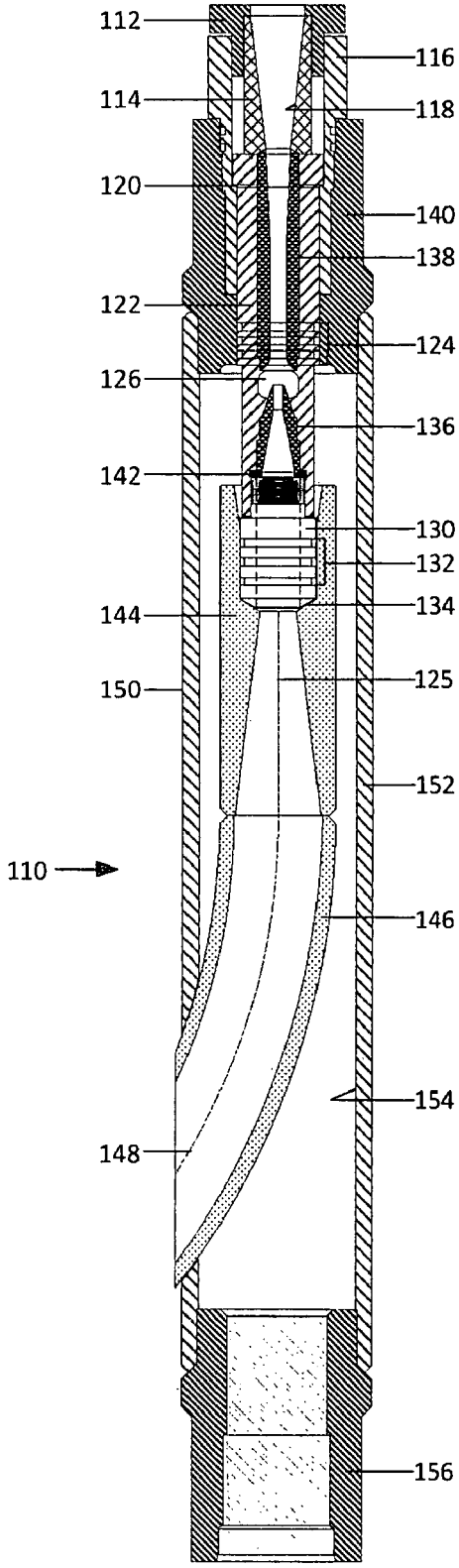
FIG. 6 is a cross-sectional view of a downhole jet pump for recovery of formation fluid through a tubing string.

FIG. 6 shows an alternate embodiment of the jet pump adapted for receiving power fluid from the annulus of a well and pumping the power fluid and the formation fluid to the surface through a tubular string. The jet pump 110 includes an exterior pump housing 152 which defines an elongate housing passageway therein extending from an upper portion to a lower portion of the pump housing. The exterior pump housing 152 preferably has a generally outer cylindrical surface 150 and a generally cylindrical surface 154 which defines the passageway in the pump housing. The pump housing is thus generally tube or sleeve shaped, with its ends threaded, welded, or otherwise secured to a top pin 140 and a bottom pin 156, respectively. The sleeve 116 is adapted for sealing engagement with cap 112, and also for sealed engagement with a top pin 140, which is supported on the upper end of housing 152. Sleeve 116 includes shoulder 120 for supporting the carrier 122 therein. Sleeve 116 in turn is supported on the top pin 140, and includes a plurality of shoulders for receiving the sleeve 116. A short component 124 may include o-ring grooves for sealing with top pin 140, and is sealed with the carrier. Cap 112 supports diffuser 114, which has interior frusto-conical wall 118. Although not shown in FIG. 6, pump 110 optionally may include the components of the inlet valve shown in FIG. 1 for allowing fluid to enter the interior of the pump housing.

For the FIG. 6 application, the pump inlet for the power fluid is formed by the curved sleeve shaped member 146, which preferably has its inlet inclined downward relative to the central axis 125 of the pump housing. Fluid passing from the annulus passes through bore 148 in member 146, then into body 144 having a frusto-conical inlet, which may be welded at its lower end to the top of curved sleeve 146. Body 144 preferably has its central axis substantially aligned with the central axis 125 of the pump housing. The upper end of body 144 has a seat 134 for receiving the lower end 130 of carrier 122. The curved sleeve 146 and body 144 may be formed from materials similar to those used to form the diffuser shown in FIG. 1, and may also have the same configuration as the FIG. 1 diffuser.

The carrier 122 has through ports 126 circumferentially arranged about the carrier. The materials from which the carrier is formed and the size and relationship of ports 126 in the carrier may be substantially as discussed for the carrier 40 shown in FIG. 1.

As with the previously disclosed embodiment, the mixing tube 138 is preferably formed as a unitary component formed from a tungsten carbide material with an expanding fluid passageway therein for discharging upward fluids entering the pump housing and passing radially through the venturi ports, as well as power fluid entering the pump through inlet 146. Mixing tube 138, and thus components of the assembly as shown in FIG. 6 below the mixing tube 138, including the carrier 122 and the nozzle 136 supported within the carrier, may thus be temporarily locked within the housing for disassembly at the surface when the entire pump is retrieved. Nozzle 136 may include a lower flange 142 for supporting the nozzle within the carrier. Carrier 122 may include a plurality of vertically spaced flange surfaces 132 on expanded lower body 130 each adapted to receive an O-ring or other seal for sealing with the upper end of the diffuser. The lower component of the carrier 122 may seat with shoulder 134 on the body 144 to effectively hold the carrier downward.

Due to the configuration of the FIG. 6 embodiment, the inner workings of the pump 110 cannot be removed by a reverse flow operation. The pump 110 thus does not include a significant feature of the pump 10 discussed above.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations, and modifications, including but not limited to those design alternatives specifically discussed herein, may be made in the practice of the invention without departing from its scope.

What is claimed is:

1. A downhole jet pump for positioning in a well from a tubular string to pump formation fluid from the well, the jet pump comprising:

an exterior pump housing defining an elongate housing passageway therein having a central axis and extending from an upper portion to a lower portion of the pump housing;

a power fluid jet nozzle having an exterior sealed to the pump housing, the jet nozzle having a jet passageway therein for increasing fluid velocity of power fluid transmitted through the jet nozzle;

a mixing tube fluidly downstream from the jet nozzle and having an elongate mixing tube passageway receiving fluid from the jet nozzle;

a plurality of venturi ports for drawing formation fluids from within the housing radially through the venturi ports and into the mixing tube;

a nose piece within the housing fluidly downstream from the mixing tube, the nose piece having a nose piece passageway in fluid communication with the mixing tube passageway, the nose piece passageway substantially aligned with the central axis of the pump housing; and a diffuser fluidly downstream from the nose piece and having a curved flow path therein, the lower end of the nose piece sealing within a bore in an upper end of the diffuser, a lower end of the diffuser passing through a side port in the pump housing for discharging a mixture of power fluid and formation fluids to the annulus surrounding the pump housing, a discharge end of the curved flow path of the diffuser angled with respect to the central axis of the pump housing, the diffuser having a rigid body from the upper end of the diffuser to the side port in the pump housing, an interior surface of the rigid body being clad with a metal coating;

an inlet valve positioned below the diffuser for controlling the passage of formation fluid into a flow path within the pump housing radially external of the diffuser, then through the venturi ports, and then into the mixing tube, the inlet valve including a ball cage including a seating surface for seating with a ball when in the closed position, the ball cage having a ball positioning surface above the seating surface for engaging the ball when the inlet valve is opened, the ball positioning surface having a radius substantially equal to or greater than the radius of the ball, and the ball cage having radially extending through passageways axially between the seating surface and the ball positioning surface to pass fluid to the flow path in the pump housing.

2. A downhole jet pump as defined in claim 1, wherein the exterior pump housing has a generally outer cylindrical surface and a generally inner cylindrical surface defining the passageway in the pump housing.

3. A downhole jet pump as defined in claim 1, wherein the jet nozzle is supported within the pump housing from a carrier retrievable to the surface while the pump housing remains downhole, with the jet nozzle fluidly sealed to the carrier and the carrier fluidly sealed to the pump housing.

4. A downhole jet pump as defined in claim 1, wherein the nose piece passageway expands in cross-sectional area prior to fluid entering the interior surface of the diffuser.

5. A downhole jet pump as defined in claim 1, wherein the nose piece is provided with a carbide material liner continuous from the mixing tube to the diffuser.

6. A downhole jet pump as defined in claim 5, wherein the carbide material liner is shrink fit within the nose piece.

7. A downhole jet pump as defined in claim 6, wherein the carbide material liner is selected from one of a group consisting of tungsten carbide, silicon carbide, and boron carbide.

8. A downhole jet pump as defined in claim 1, further comprising:

a carrier for supporting the jet nozzle, the carrier having three venturi ports extending from the mixing tube passageway radially through a side wall in the carrier and to the interior passageway in the pump housing, the venturi ports being spaced substantially equidistant circumferentially about the carrier.

9. A downhole jet pump as defined in claim 8, wherein the carrier is formed from powdered metallurgy material with voids, surfaces of the carrier being coated with a vapor deposition material which penetrates the carrier through the voids.

10. A downhole jet pump as defined in claim 1, wherein the nose piece includes a carbide material liner shrink fit within the nose piece.

11. A downhole jet pump as defined in claim 10, wherein the carbide material liner is selected from one of a group consisting of tungsten carbide, silicon carbide, and boron carbide.

12. A downhole jet pump as defined in claim 1, wherein the diffuser has its upper end in fluid communication with the nose piece and its lower end passing through the side port in the pump housing.

13. A downhole jet pump as defined in claim 1, wherein each venturi port has a substantially rectangular cross-sectional configuration.

14. A downhole jet pump as defined in claim 1, wherein substantially the entirety of the inner surface of the mixing tube is covered with a vapor deposition material.

15. A downhole jet pump as defined in claim 1, wherein the jet nozzle is supported within the pump housing from a carrier, with the jet nozzle fluidly sealed to the carrier and the carrier fluidly sealed to the pump housing.

16. A downhole jet pump as defined in claim 1, wherein the power fluid is pumped down a tubular string and fluid is recovered at the surface via an annulus about the tubular string.

17. A downhole jet pump as defined in claim 1, wherein the power fluid is pumped down the annulus about a tubular string and fluid is recovered at the surface via the tubular string.

18. A downhole jet pump as defined in claim 1, wherein the ball cage is formed from a powdered metallurgy material with voids.

19. A downhole jet pump for positioning in a well from a tubular string to pump formation fluid from the well toward the surface, the jet pump comprising:

an exterior pump housing defining an elongate housing passageway therein extending from an upper portion to a lower portion of the pump housing;

a retrievable carrier within the pump housing for supporting a power fluid jet nozzle and for retrieving the carrier and jet nozzle while the pump housing remains in the well;

the power fluid jet nozzle having a jet passageway therein for increasing fluid velocity of power fluid transmitted through the jet nozzle;

a mixing tube within the pump housing, the mixing tube being fluidly downstream from the jet nozzle and having an elongate mixing tube passageway receiving fluid from the jet nozzle;

the carrier including a plurality of venturi ports for drawing formation fluids from within the housing radially interior through the venturi ports and into the mixing tube; and an inlet valve positioned below the mixing tube for controlling the passage of formation fluid axially through a lower end of the pump housing, through the venturi ports, and into the mixing tube, the inlet valve including a ball cage having a seating surface for seating with a ball when in the closed position, the ball cage having a ball positioning surface above the seating surface, and the ball cage having radially extending through passageways axially below the ball positioning surface to pass fluid to a flow path in the pump housing.

20. A downhole jet pump as defined in claim 19, wherein the ball cage has a ball positioning surface for engaging the ball when the inlet valve is fully opened, the ball positioning surface with a radius substantially equal to or greater than the radius of the ball.

21. A downhole jet pump as defined in claim 19, further comprising:

the carrier supporting the jet nozzle, the carrier having three venturi ports extending from the mixing tube passageway radially through a side wall in the carrier and to the interior passageway in the exterior pump housing, the venturi ports being spaced substantially equidistant circumferentially about the carrier.

22. A downhole jet pump as defined in claim 19, further comprising:

a diffuser above the inlet valve, a lower end of the diffuser passing through a side port in the pump housing for discharging a mixture of power fluid and formation fluids to the annulus surrounding the pump housing.

23. A downhole jet pump as defined in claim 19, further comprising:

the exterior pump housing having a generally outer cylindrical surface and a generally inner cylindrical surface defining the passageway in the pump housing; and a nose piece within the housing fluidly downstream from the mixing tube, the nose piece having a nose piece passageway in fluid communication with the mixing tube passageway.

24. A downhole jet pump as defined in claim 19, further comprising:

a nose piece within the housing fluidly downstream from the mixing tube, the nose piece having a nose piece passageway in fluid communication with the mixing tube passageway.

25. A downhole jet pump as defined in claim 24, further comprising:

a diffuser fluidly downstream from the nose piece, the lower end of the nose piece sealing within a bore in an upper end of the diffuser, a lower end of the diffuser passing through a side port in the pump housing for discharging a mixture of power fluid and formation fluids to the annulus surrounding the pump housing.

26. A downhole jet pump as defined in claim 19, wherein the retrievable carrier has three circumferentially spaced venturi ports.

27. A downhole jet pump as defined in claim 19, further comprising:

a nose piece within the housing fluidly downstream from the mixing tube, the nose piece having a carbide material liner in fluid communication with the mixing tube passageway.

28. A downhole jet pump as defined in claim 27, wherein the carbide material liner is selected from one of a group consisting of tungsten carbide, silicon carbide, and boron carbide.

29. A downhole jet pump as defined in claim 19, wherein the carrier is formed from powdered metallurgy material with voids, surfaces of the carrier being coated with a vapor deposition material which penetrates the carrier through the voids.

30. A downhole jet pump for positioning in a well from a tubular string to pump formation fluid to the surface, the jet pump comprising:

an exterior pump housing defining an elongate housing passageway therein extending from an upper portion to a lower portion of the pump housing;

a power fluid jet nozzle, the jet nozzle having a jet passageway therein for increasing fluid velocity of power fluid transmitted to the jet nozzle;

a mixing tube within the pump housing, the mixing tube having an elongate mixing tube passageway receiving fluid from the jet nozzle;

a retrievable carrier having three venturi ports extending from the interior passageway in the pump housing, radially through a side wall of the carrier and to the mixing tube passageway, the retrievable carrier supporting the power fluid jet nozzle and the mixing tube when retrieved to the surface while the pump housing remains downhole, each venturi port having a generally rectangular cross-sectional flowpath configuration, the venturi ports being spaced substantially equidistant circumferentially about the carrier; and an inlet valve positioned below the mixing tube and passing formation fluid into the pump housing and to the venturi ports, the inlet valve including a ball cage having a seating surface for seating with a ball when in the closed position, the ball cage having a ball positioning surface above the seating surface, the ball cage having radially extending passageways axially between the seating surface and the ball positioning surface to pass fluid to a flow path in the pump housing.

31. A downhole jet pump as defined in claim 30, further comprising:

the exterior pump housing has a generally outer cylindrical surface and a generally inner cylindrical surface defining the passageway in the pump housing.

32. A downhole jet pump as defined in claim 30, further comprising:

a diffuser fluidly downstream from the mixing tube, a lower end of the diffuser passing fluid to the tubing string.

33. A downhole jet pump as defined in claim 30, wherein the retrievable carrier is formed from powdered metallurgy material with voids, surfaces of the carrier being coated with a vapor deposition material which penetrates the carrier through the voids.

34. A downhole jet pump as defined in claim 33, wherein substantially the entirety of the inner surface of the mixing tube is covered with the vapor deposition material.

35. A downhole jet pump for positioning in a well from a tubular string to pump formation fluid from the well into an annulus surrounding the tubing string and through the tubing string to the surface, the jet pump comprising:

an exterior pump housing defining an elongate housing passageway therein extending from an upper portion to a lower portion of the pump housing;

a retrievable tubular carrier within the pump housing for supporting a power fluid jet nozzle therein and for retrieving the carrier and the jet nozzle while the pump housing remains in the well;

the power fluid jet nozzle having an exterior sealed to the pump housing, the jet nozzle having a jet passageway therein for increasing fluid velocity of power fluid transmitted to the jet nozzle;

a mixing tube within the pump housing, the mixing tube having an elongate mixing tube passageway;

the tubular carrier having a plurality of circumferentially spaced venturi ports extending from the interior passageway in the pump housing, and radially through a side wall of the carrier and to the mixing tube passageway, the venturi ports being spaced substantially equidistant circumferentially about the tubular carrier and each venturi port having a substantially rectangular cross-sectional configuration; and an inlet tube fluidly upstream from the mixing tube, the inlet tube passing through a side port in the pump housing for drawing power fluid into the pump housing.

36. A downhole jet pump as defined in claim 35, wherein the exterior pump housing has a generally outer cylindrical surface and a generally inner cylindrical surface defining the passageway in the pump housing.

37. A downhole jet pump as defined in claim 35, wherein substantially the entirety of the inner surface of the mixing tube is covered with a vapor deposition material.

38. A downhole jet pump as defined in claim 35, wherein the jet nozzle is fluidly sealed to the carrier and the carrier fluidly sealed to the pump housing.

39. A downhole jet pump as defined in claim 35, wherein the power fluid is pumped down a tubular string and fluid is recovered at the surface via an annulus about the tubular string.

40. A downhole jet pump as defined in claim 35, further comprising:

an exterior pump housing having a generally outer cylindrical surface and a generally inner cylindrical surface defining the passageway in the pump housing.

41. A downhole jet pump as defined in claim 35, wherein the carrier is formed from powdered metallurgy material with voids, surfaces of the carrier being coated with a vapor deposition material which penetrates the carrier through the voids.

* * * * *